US008516757B2

(12) United States Patent
Keller

(10) Patent No.: US 8,516,757 B2
(45) Date of Patent: Aug. 27, 2013

(54) REINFORCEMENT ELEMENT FOR ABSORBING FORCES IN CONCRETE ELEMENTS WHICH ARE SUPPORTED BY SUPPORT ELEMENTS

(75) Inventor: Thomas Keller, Lully (CH)

(73) Assignee: F.J. Aschwanden AG, Lyss (CH)

( * ) Notice: Subject to any disclaimer, the term of this patent is extended or adjusted under 35 U.S.C. 154(b) by 37 days.

(21) Appl. No.: 13/364,377

(22) Filed: Feb. 2, 2012

(65) Prior Publication Data

US 2012/0205515 A1 Aug. 16, 2012

(30) Foreign Application Priority Data

Feb. 15, 2011 (EP) ..... 11154442

(51) Int. Cl.
*E04C 5/08* (2006.01)

(52) U.S. Cl.
USPC ..... 52/223.14; 52/251; 52/648.1

(58) Field of Classification Search
USPC ..... 52/167.1, 167.3, 167.7, 167.8, 250, 52/251, 260, 223.14, 223.4, 223.6, 648.1, 52/649.1
See application file for complete search history.

(56) References Cited

U.S. PATENT DOCUMENTS 975,307 A * 11/1910 White et al. ..... 52/260
1,031,047 A * 7/1912 Conzelman ..... 52/259
1,133,658 A * 3/1915 Norcross ..... 52/260
2,768,520 A * 10/1956 Strehan ..... 52/260
3,283,458 A 11/1966 Gersovitz
3,302,360 A * 2/1967 Bjerking ..... 52/600
4,406,103 A * 9/1983 Ghali et al. ..... 52/260
5,846,364 A * 12/1998 Policelli ..... 156/169
6,385,930 B1 * 5/2002 Broms et al. ..... 52/251
2011/0083386 A1 4/2011 Keller

FOREIGN PATENT DOCUMENTS

EP 1180565 A1 2/2002
EP 2236686 A1 10/2010

OTHER PUBLICATIONS

European Search Report for corresponding European App EP 11 15 4442 dated Jul. 20, 2011.
JP2001262842, Sep. 26, 2001, Yokohama Ruber Co. Ltd., Patent Abstracts of Japan (and full document).

* cited by examiner

*Primary Examiner* — Robert Canfield
*Assistant Examiner* — Brent W Herring
(74) *Attorney, Agent, or Firm* — WRB-IP LLP

(57) ABSTRACT

A reinforcement element for absorbing forces in concrete elements that are supported by support elements includes a longitudinally stable, flexible longitudinal element. This element is placed in recesses in the concrete element which are disposed in such a way that in the region of the support element the reinforcement element runs in the area of the concrete element remote from the support element. The end regions of the reinforcement element each run at an acute angle toward the surface of the concrete element turned toward the support element, and exit from the concrete element. Both end regions of the longitudinally stable, flexible longitudinal element are diverted around the respective exit edge of the recesses, are led into a tensioning device, are held therein, and can be tensioned with respect to one another. The reinforcement element thereby forms a closed loop; the arising forces can be absorbed in an optimal way.

12 Claims, 8 Drawing Sheets

REINFORCEMENT ELEMENT FOR ABSORBING FORCES IN CONCRETE ELEMENTS WHICH ARE SUPPORTED BY SUPPORT ELEMENTS

BACKGROUND AND SUMMARY

This invention relates to a reinforcement element for absorbing forces in concrete elements that are supported by support elements, comprising a longitudinally stable, flexible longitudinal element, which is placed in recesses in the concrete element, which recesses are disposed in such a way that the reinforcement element runs in the region of the support element in the area of the concrete element remote from the support element and runs in each case at an acute angle $\alpha$ toward the surface of the concrete element turned toward the support element and exits out of the concrete element and in that the end regions of the reinforcement element are anchored.

It is often necessary for reinforcements to be installed in existing structures, in particular with concrete elements that are supported by support elements, in order to be able to better absorb the arising forces. To this end there are the most diverse possibilities. For example, bores can be made in the areas to be reinforced of the concreted plate, which bores are disposed obliquely and in which tension anchors can be placed. The ends protruding beyond the concreted plate on both sides are provided with anchor heads which are supported on the respective surface of the concreted plate. The anchor heads can be designed such that the pulling element of the tension anchor can be tensioned. The bore can be filled with a grout-type material.

From EP A 2236686 (corresponds to US2011/0083386) it is also known to use a longitudinally stable, flexible band of carbon fiber-reinforced plastic, which is disposed in correspondingly made bores in the concrete element, the two ends of this band protruding on the surface of the concrete element turned toward the support and being held in anchors. This band can be tensioned through tensioning devices installed on the anchors. The bores can be subsequently grouted, whereby a very good reinforcement of the concrete element in the area of the support is achieved.

It is desirable to provide an improved reinforcement element for absorbing forces in concrete elements that are supported by support elements, which improved reinforcement element serves the purpose of absorbing large-scale stresses and which is easy to install.

According to an aspect of the invention, both end regions of the longitudinally stable, flexible longitudinal element are diverted around the respective exit edge of the recesses of the concrete element and are disposed running toward one another, and the ends of the longitudinally stable, flexible longitudinal element are held in a tensioning device and are able to be tensioned with respect to one another, so that the reinforcement element forms a closed loop.

Achieved with this design is that the two ends of the longitudinally stable, flexible longitudinal element placed in the concrete element can be put in the tensioning device in a simple way and that a simple tensioning of the longitudinal element can be achieved whereby an optimal tensioning step can be carried out. The respective forces are also thereby distributed in an optimal way.

The reinforcement element is preferably placed in the concrete element in such a way that it is disposed laterally adjacent to the support element. The reinforcement element forming a closed loop thereby comes to lie in one plane.

The longitudinally stable, flexible longitudinal element preferably has the form of a band, whose width is a multiple of the thickness, whereby an optimal diversion is achievable.

The longitudinally stable, flexible longitudinal element is preferably composed of carbon fiber-reinforced plastic. Besides the absorption of large-scale tension forces, a simple handling is also thereby obtained.

In order to be able to achieve an optimal absorption of the arising forces, the angle $\alpha$ is preferably in the range of 20° to 50°.

An especially simple embodiment of the invention is achieved in that the tensioning device is designed as tension lock and in that the two ends of the longitudinally stable, flexible longitudinal element are designed as loops and are held in the tension lock.

Another advantageous embodiment of the invention is in that installed in the region of the exit edges of the recesses are diversion elements, via which the respective band is diverted in a guided way, and no edges thereby arise.

In order to transfer the forces optimally of the reinforcement element in the region of the exit edge, the diversion element preferably has support surfaces, which are supported on the respective surface of the end region of the recess and/or on the surface of the concrete element.

In order to be able to further relieve these exit edges, the diversion element is attached to an end region of a supporting piece, whose other end region supports itself on the support element.

Preferably the supporting piece has the form of a plate and a plurality of diversion elements is attached to a plate, which simplifies the construction.

A further advantageous embodiment of the invention is in that the recesses made in the concrete element, through which the reinforcement element is led, are grouted with a pourable material, whereby water or the like can be prevented from penetrating into the recesses.

In order to be able to achieve an optimal absorption of forces in concrete elements that are supported by support elements in the area of these support elements, it is advantageous if a system is used comprising a plurality of such reinforcement elements, whereby preferably two reinforcement elements each are aligned parallel to one another and are disposed opposite one another and laterally with respect to the support elements.

BRIEF DESCRIPTION OF THE DRAWINGS

Embodiments of the invention will be explained more closely in the following, by way of example, with reference to the attached drawings.

DETAILED DESCRIPTION

Figure 1:
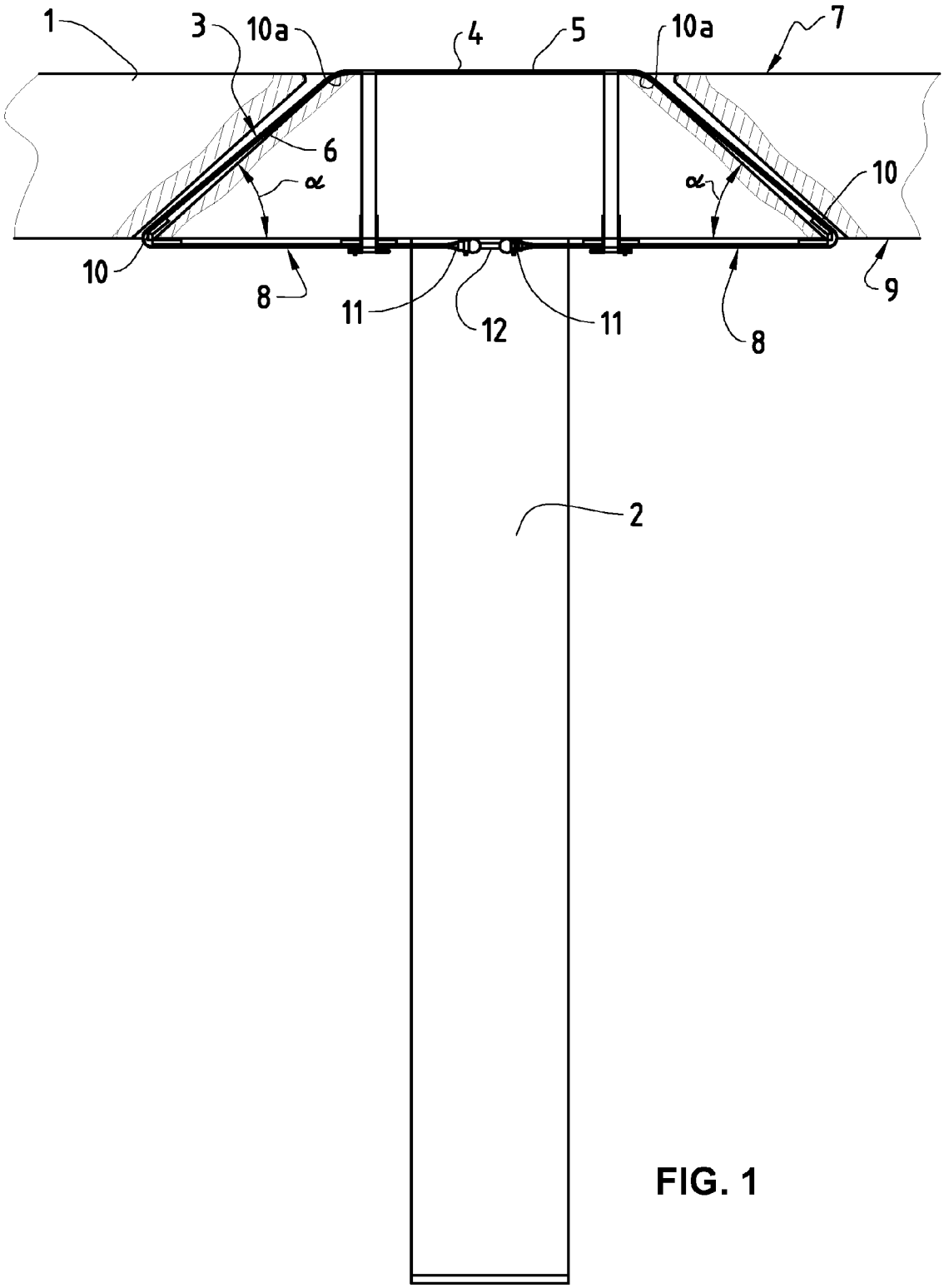
FIG. 1 shows a concrete element represented in section with inserted reinforcement elements in the region of the support element.

From FIG. 1 a concrete element 1 can be seen which has the form of a concrete slab which is supported by a support element 2. For reinforcement of the concrete element and for better absorption of the supporting and shearing forces in the concrete element 1, which are exerted by the support element 2, reinforcement elements 3 are inserted in the concrete element 1. Each of these reinforcement elements 3 consists of or comprises a longitudinally stable, flexible longitudinal element 4, which has the form of a band 5 whose width is a multiple of the thickness in a known way and which is composed of a carbon fiber-reinforced plastic in a known way. Of course bands made of other suitable materials can also be used.

In order to be able to insert these longitudinally stable, flexible longitudinal elements 4 in the concrete element 1, recesses 6 are made in the latter. Inserted into these recesses 6 is a band 5, these recesses 6 being each disposed in such a way that the band 5 runs in the area 7 of the concrete element 1 remote from the support element 2 and the end regions 8 of the band 5 each run at an acute angle $\alpha$ toward the surface 9 of the concrete element 1 turned toward the support element 2, and exit out of the concrete element 1. The two end regions 8 of the band 5 are diverted around the respective exit edges 10 of the recesses 6 of the concrete element 1. These end regions 8 of the band 5 emerging out of the concrete element 1 are disposed running toward each other. The ends 11 of the band 5 are held in a tensioning device 12 and are able to be tensioned with respect to one another, as will be described in detail later. The reinforcement element formed by the band 5 thereby forms a closed loop.

The band 5 can also be inserted into the recesses 6 in such a way that this band runs in the region of the concrete element 1 turned toward the support element 2 and the two end regions 8 of the band 5 thus exist out of the concrete element 1 on the surface remote from the support element 2, in a way diverted around the exit edges 10*a* and running toward one another. The ends 11 of the band 5 are held in a tensioning device 12 and are able to be tensioned with respect to one another. The reinforcement element 3 formed by the band 5 thereby likewise forms a closed loop.

Figure 2:
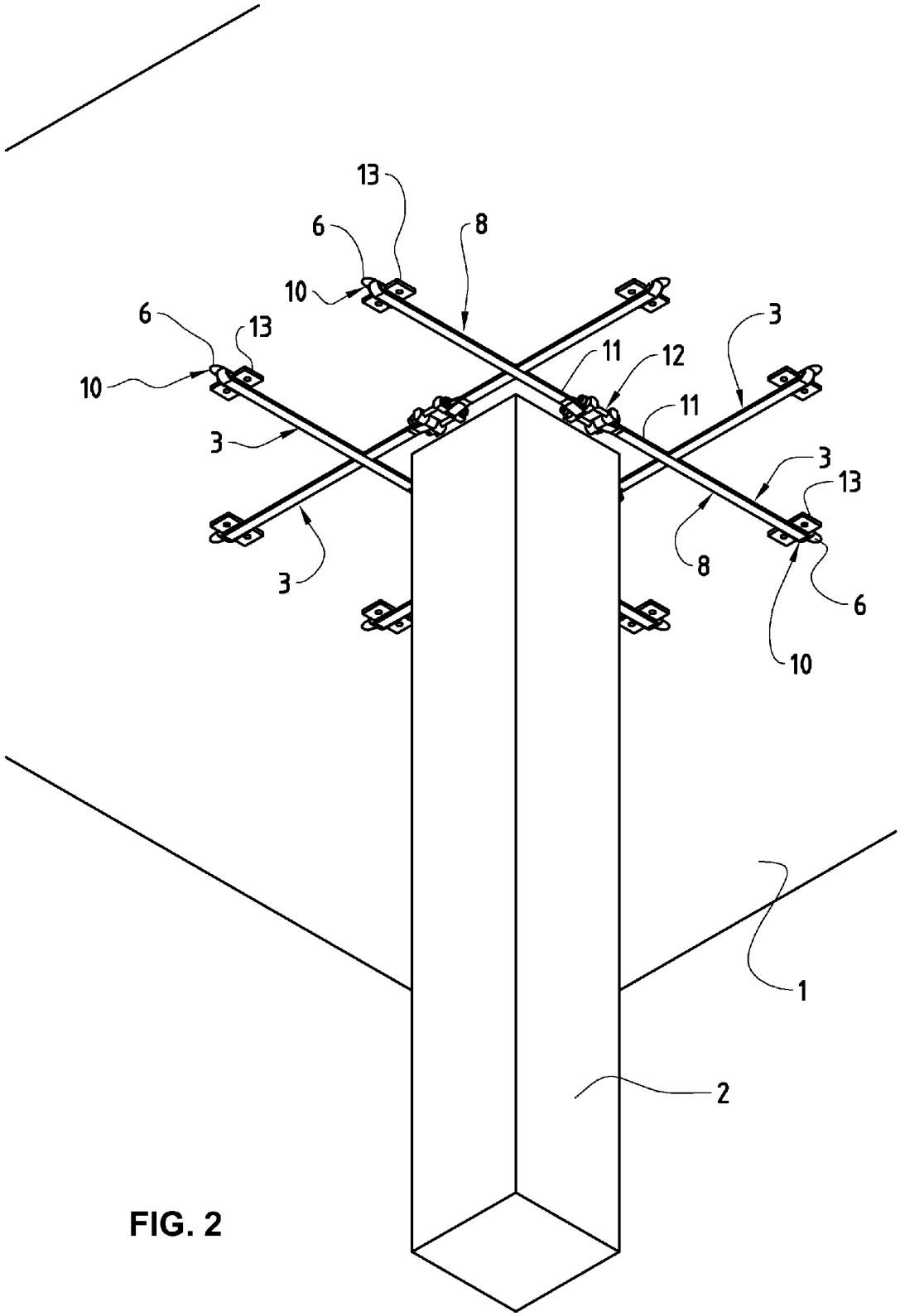
FIG. 2 shows in a three-dimensional representation a view of the surface of the concrete element turned toward the support element with inserted reinforcement elements.

How a plurality of reinforcement elements 3 can be disposed in the region of a support element 2 for reinforcement of a concrete element 1 can be learned from FIG. 2. The recesses 6 in the concrete element 1 are disposed in this embodiment in such a way that in each case the reinforcement elements 3 forming a closed loop run laterally adjacent to the support element 2 so that this closed loop of the reinforcement element 3 lies in a plane that runs substantially perpendicular to the concrete element 1. In the embodiment example shown in FIG. 2, the support element 2 has a parallelepiped-shaped cross section; in an advantageous way the reinforcement elements 3 are aligned parallel to the respective surface of the parallelepiped of this support element 2, so that in each case two reinforcement elements 3 are aligned parallel to one another. As has already been mentioned, the end regions 8 extending beyond the concrete element 1 are led around diversion elements 13 in the region of the exit edge 10, which diversion elements will be described in detail later, by means of which stress peaks in the region of the exit edges 10 can be avoided. The ends 11 of the reinforcement elements 3 are held in a tensioning device 12, which will also be described in detail later, with which these ends 11 are able to be tensioned with respect to one another.

Figure 3:
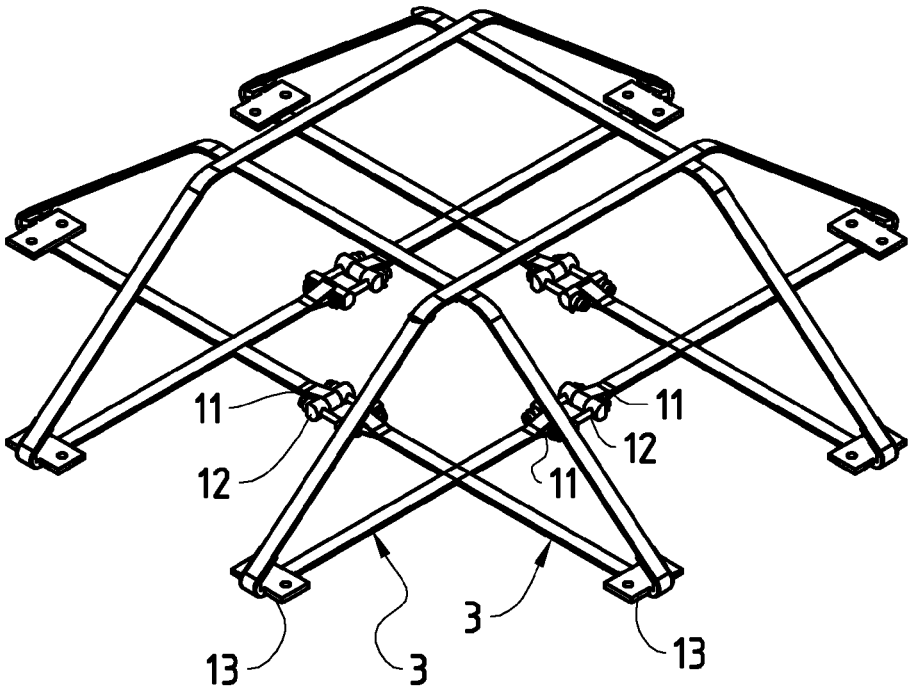
FIG. 3 shows in a three-dimensional representation the configuration of the reinforcement elements in the corresponding concrete element, this concrete element and the support element not being shown.

The course of the reinforcement elements 3 as they are shown in FIG. 2 in the state of being inserted in the concrete element 1 can be seen from FIG. 3, the concrete element 1 and the support element 2 not being shown in FIG. 3. Hereby visible is how the reinforcement elements 3 each lie in a plane, and how they form a closed loop, in which the ends 11 are held in the respective tensioning device 12 and are tensioned with respect to one another. Likewise visible are the diversion elements 13, which are provided in the respective lower deviating points of the of the reinforcement element 3.

In a known way (not shown), corresponding diversion elements can be provided on the respective upper deviating points of the reinforcement element 3.

Figure 4:
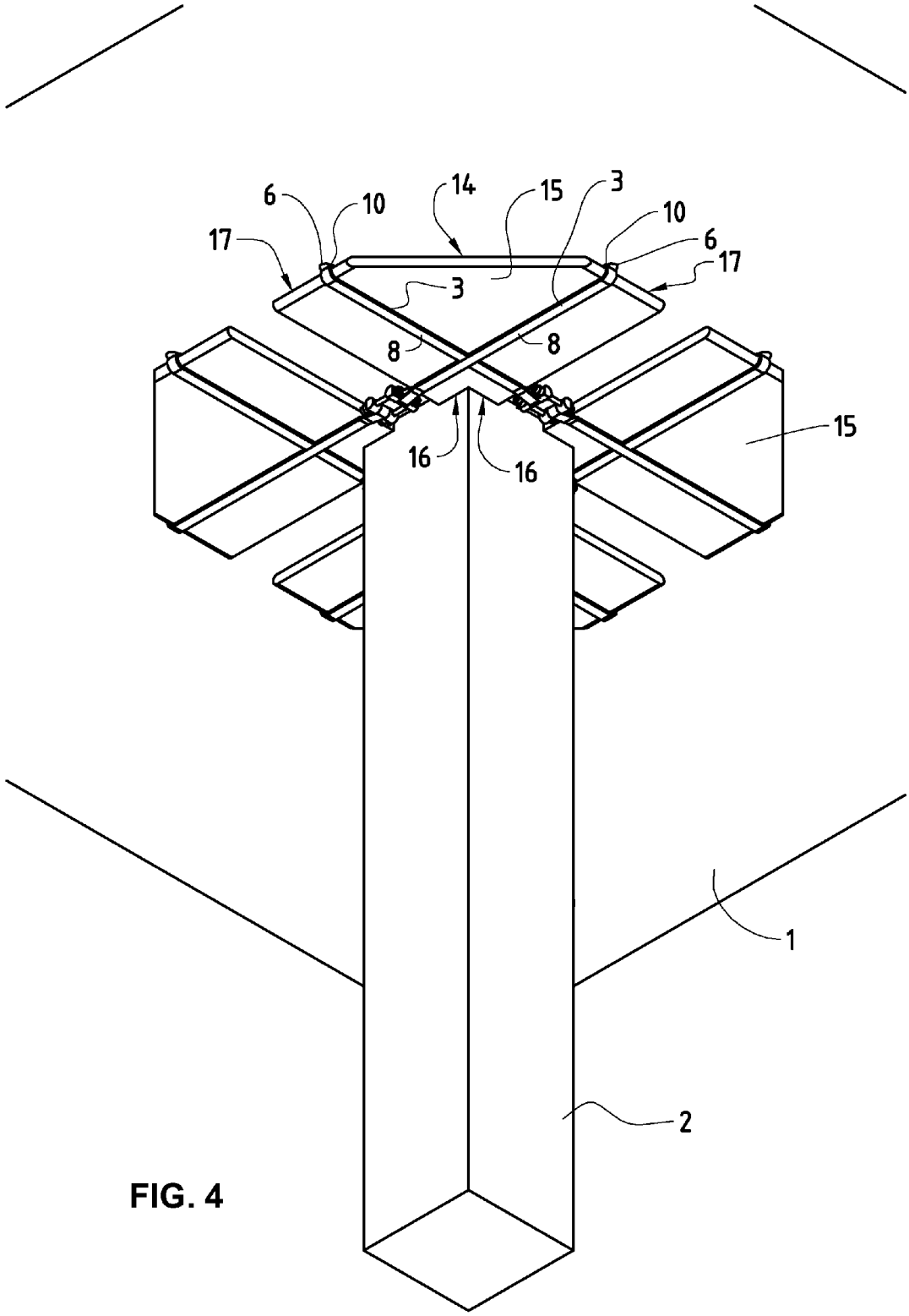
FIG. 4 shows in a three-dimensional representation a view of the surface turned toward the support element with inserted reinforcement elements with supporting pieces disposed in the form of plates.
Figure 5:
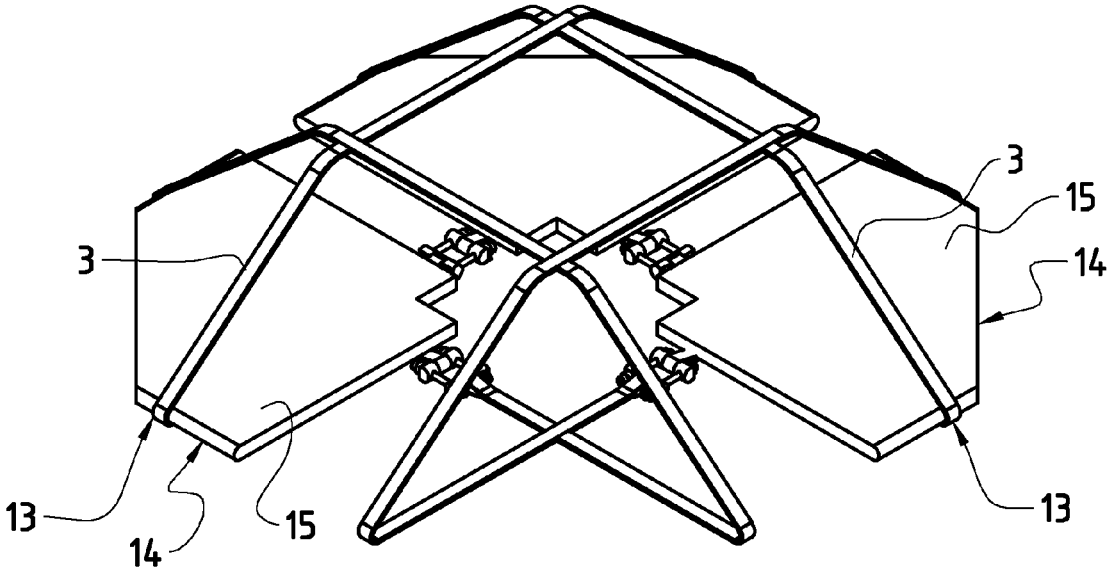
FIG. 5 shows in a three-dimensional representation the reinforcement elements disposed in the concrete element (not shown) with plate-shaped supporting pieces.

As can be seen from FIGS. 4 and 5, the diversion elements 13 about which the respective reinforcement element 3 is diverted in a guided way at the respective exit edge 10 of the recesses 6, can be fixed to a supporting piece 14, which in the embodiment example shown here is designed in each case as a plate 15. The inner end region 16 hereby supports itself on the support element 2. The outer end regions 17 of this plate 15 are designed as diversion elements or can be provided with corresponding diversion elements 13 about which the end regions 8 of the reinforcement element 3 exiting from the concrete element 1 are diverted. Achieved with these supporting pieces 14 is that the forces arising in the region of the exit edge 10 are transferred in an optimal way to the support element 2 and support is given there, whereby any occurring stress peaks that could have an effect upon the concrete element 1 or respectively upon the reinforcement element 3 are reduced.

Of course it is also conceivable to configure the plates 15 in such a way that the sides turned toward each other each support themselves on one another and a closed ring in formed. A supporting of the plates 15 on the support element 2 is not absolutely necessary with this embodiment.

Figure 6:
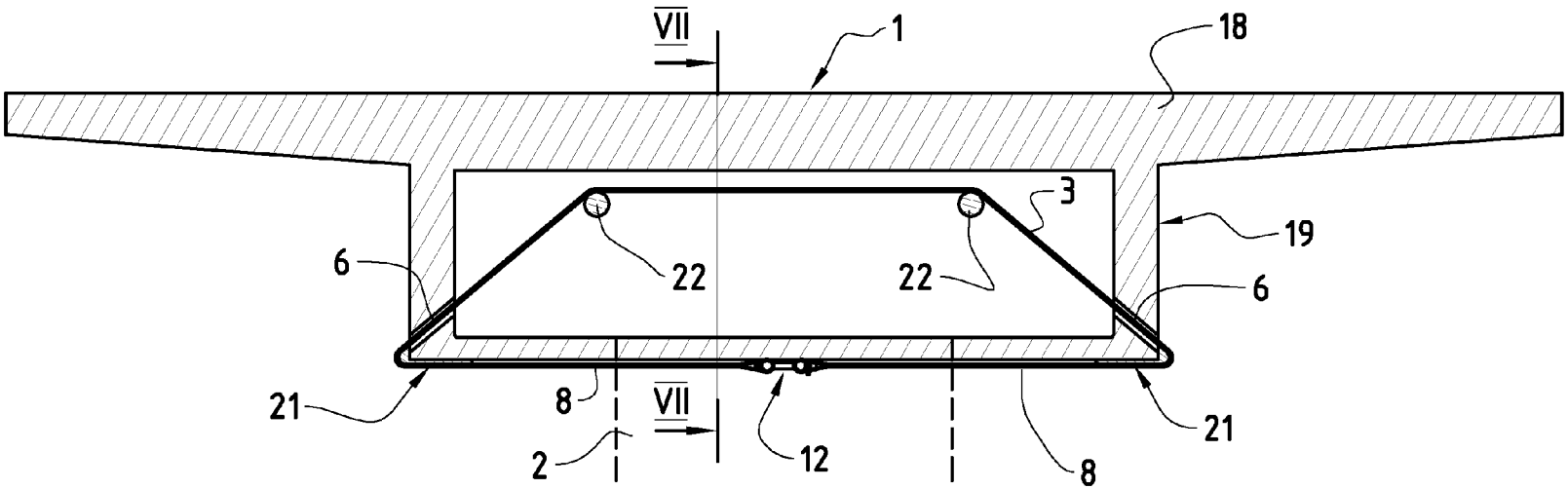
FIG. 6 shows a sectional representation through a concrete element designed as bridge part with inserted reinforcement element.
Figure 7:
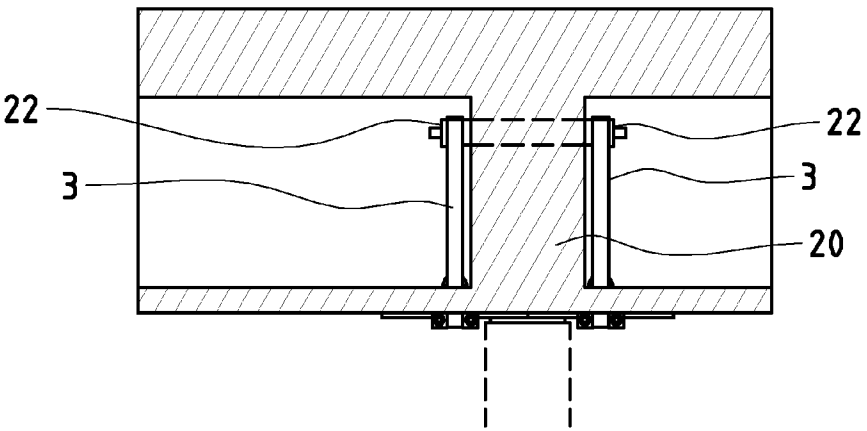
FIG. 7 shows a sectional representation through the bridge element according to FIG. 6 along line VII-VII.

The use of reinforcement elements 3 of this kind in a concrete element which is designed as bridge element is shown in FIGS. 6 and 7. This bridge element comprises a plate 18, on which a driving surface can be disposed, and a box-shaped bridge longitudinal support 19. This longitudinal support 19 is designed box-shaped, and has a hollow space. Inserted in this hollow space in a way spaced apart from one another are transverse members 20. The respective reinforcement elements 3 can be installed in the region of these transverse members 20. These reinforcement elements run laterally with respect to the transverse member 20. The end regions 8 are led through recesses 6 made on the longitudinal support 19 and exit out of the longitudinal support 19, are diverted in a guided way via diversion elements 21, and run toward one another, are held in a tensioning device 12 and are tensioned with respect to one another. Inserted in the transverse member 20 are anchor rods 22, about which the reinforcement element 3 in the region of the transverse member 20 turned toward the plate 18 are led. By means of this configuration of the reinforcement elements 3, the transfer of the forces to the support element 2 in the region of the transverse member 20 can be improved.

Figure 8:
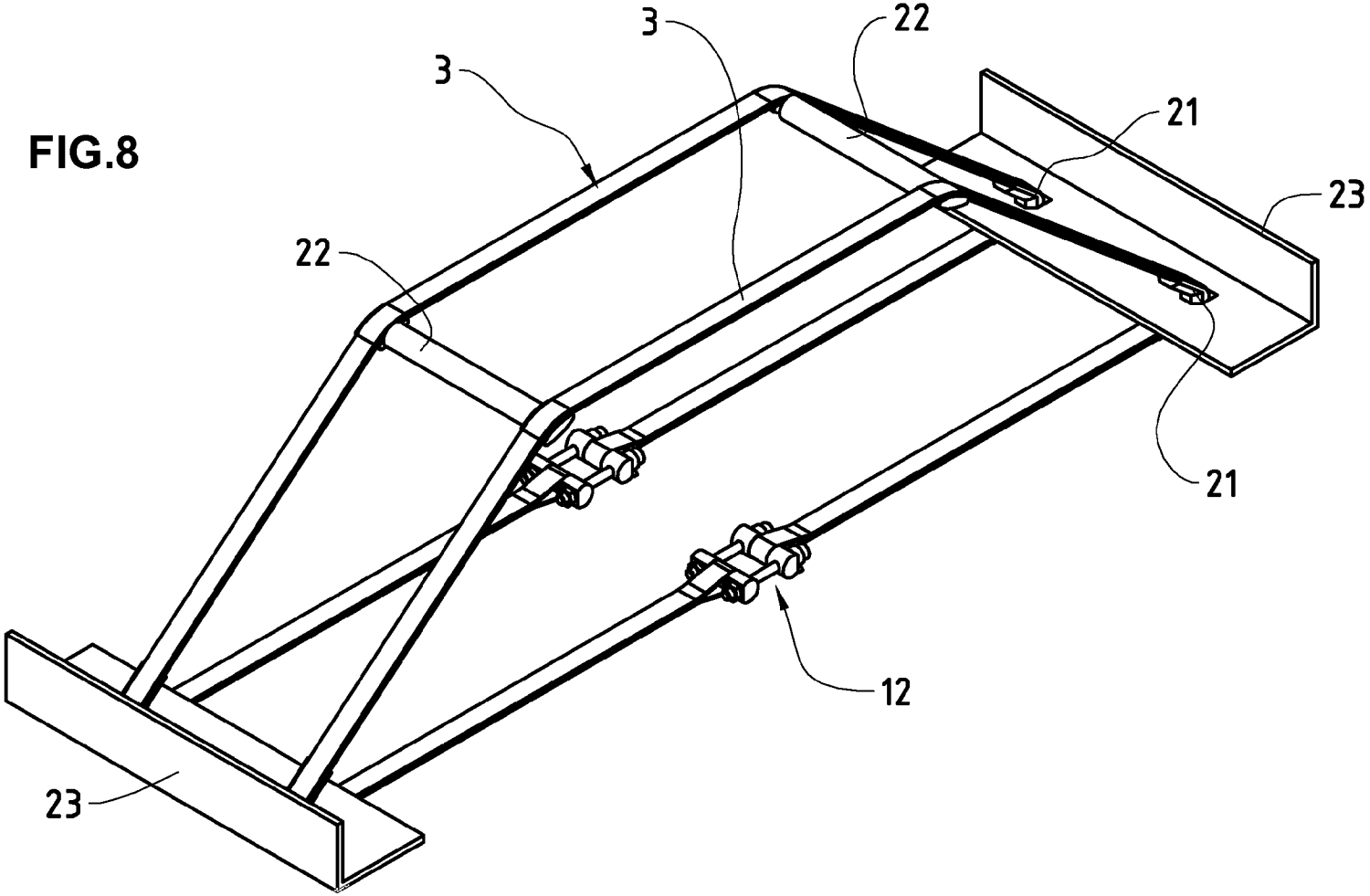
FIG. 8 shows in a three-dimensional representation the reinforcement elements inserted in the bridge element according to FIG. 6 without the bridge element being shown.

FIG. 8 shows once again the view of the course of the reinforcement elements 3 in the bridge element, as it is shown in FIGS. 6 and 7, the corresponding elements not being shown. Visible here are the anchor rods 22 about which the upper portion of the reinforcement elements 3 is led, as well as the diversion elements 21, which are additionally provided with an angular part 23 which can support itself in an optimal way in the corresponding corner regions of the longitudinal support 19.

Figure 9:
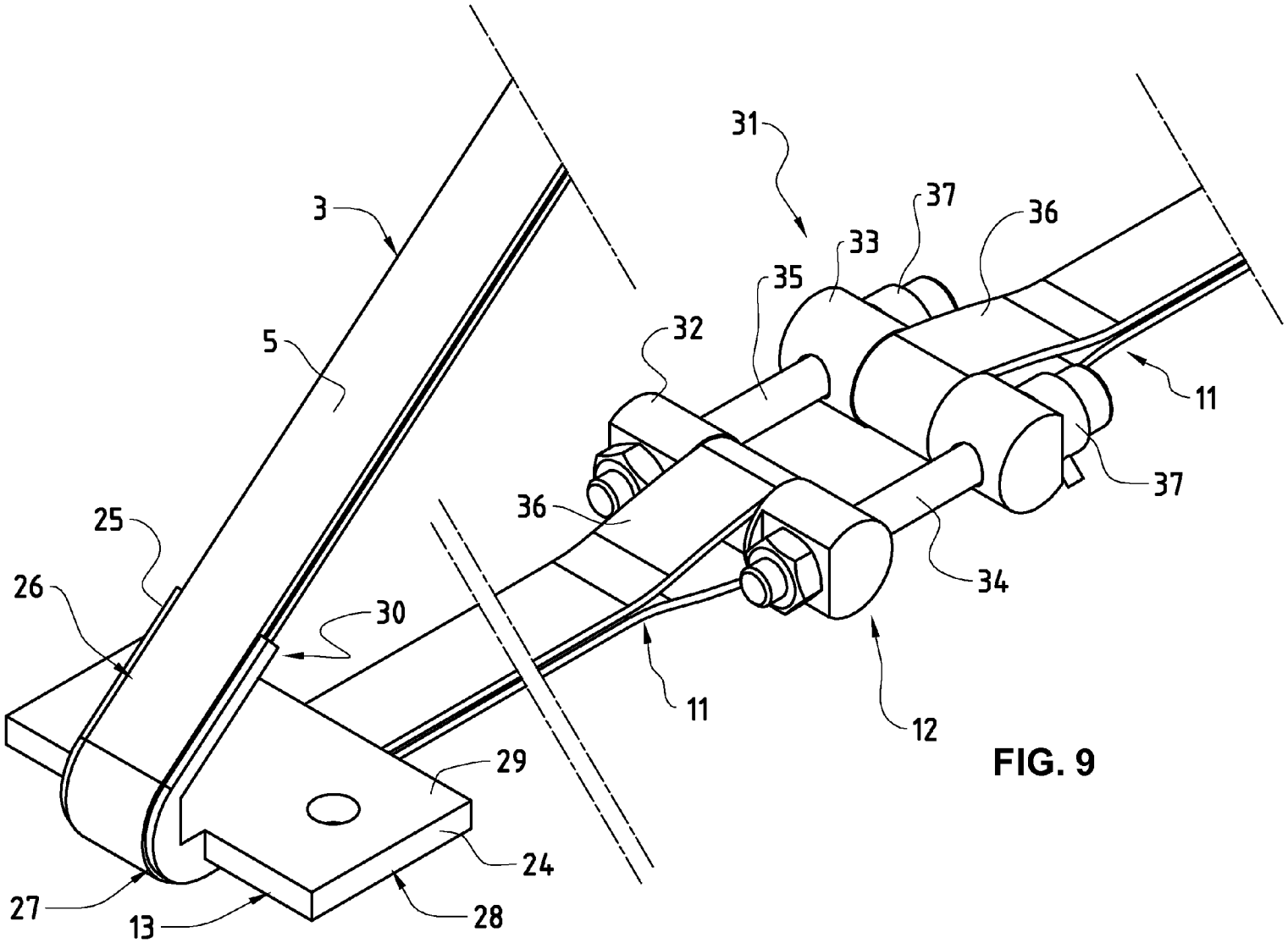
FIG. 9 shows in a three-dimensional representation a view of a diversion element and a tension lock.

FIG. 9 shows one of the previously mentioned diversion elements 13 in detail. This diversion element 13 consists of or comprises a plate 24, to which an angularly disposed guide part 25 is attached. This guide part 25 has a groove 26, in which the band 5 of the reinforcement element 3 is placed and guided. The groove 26 makes a curve 27 which comes out in the rear-side surface 28 of the plate 24. The upper-side surface 29 of the plate forms the support surface, with which the diversion element 13 supports itself on the surface 9 (FIG. 1) of the concrete element 1, turned toward the support element. The surface of the guide part 25 remote from the band 5 forms the support surface 30, by means of which the diversion element 13 supports itself on the respective surface of the end region of the corresponding recesses 6 (FIG. 1).

As is also visible from FIG. 9, the tensioning device 12 is designed as tension lock 31, made up essentially of two bolts 32 and 33, which are able to be tensioned with respect to one another in a substantially parallel way via two screws 34 and 35 in each case. The two ends 11 of the band 5 of the reinforcement element 3 are each designed as loop 36, in which the respective bolt 32 or respectively 33 is inserted. The reinforcement element 3 can thus be tensioned by turning of the screws 34 and 35. In a known way, the screws 34 and 35 of the tension lock 31 can be provided with hydraulic elements 37 with which the tension force can be applied hydraulically in a known way.

With these reinforcement elements concrete elements in the region of support elements can be reinforced in a simple and effective way, an optimal transfer of the arising forces being achieved.

The invention claimed is:

1. A reinforcement element for absorbing forces in concrete elements that are supported by support elements, comprising a longitudinally stable, flexible longitudinal element, which is placed in recesses in the concrete element, which recesses are disposed in such a way that in the region of the support element the reinforcement element runs in the area of the concrete element remote from the support element and in each case runs at an acute angle toward the surface of the concrete element turned toward the support element and exits from the concrete element and in that the end regions of the reinforcement element are anchored, wherein the two end regions of the longitudinally stable, flexible longitudinal element are diverted around the respective exit edge of the recesses of the concrete element and are disposed running toward one another, and the ends of the longitudinally stable, flexible longitudinal element are held in a tensioning device and are able to be tensioned with respect to one another so that the reinforcement element forms a closed loop.

2. The reinforcement element according to claim 1, wherein this element is placed in the concrete element in such a way that it is disposed laterally adjacent to the support element.

3. The reinforcement element according to claim 1, wherein the longitudinally stable, flexible longitudinal element has the form of a band whose width is a multiple of the thickness.

4. The reinforcement element according to claim 1, wherein the longitudinally stable, flexible longitudinal element is composed of carbon fiber-reinforced plastic.

5. The reinforcement element according to claim 1, wherein the acute angle is in the range of 20° to 50°.

6. The reinforcement element according to claim 1, wherein the tensioning device is designed as tension lock and in that the two ends of the longitudinally stable, flexible longitudinal element are designed as loops and are held in the tension lock.

7. The reinforcement element according to claim 1, wherein installed in the region of the exit edges of the recesses are diversion elements, via which the respective band is diverted in a guided way.

8. The reinforcement element according to claim 7, wherein the diversion element has support surfaces, which are supported on the respective surface of the end region of the recess and/or on the surface of the concrete element.

9. The reinforcement element according to claim 7, wherein the diversion element is attached to an end region of a supporting piece, whose other end region supports itself on the support element.

10. The reinforcement element according to claim 9, wherein the supporting piece has the form of a plate and in that a plurality of diversion elements is attached to a plate.

11. The reinforcement element according to claim 1, wherein the recesses made in the concrete element, through which the reinforcement element is led, are grouted with a pourable material.

12. A system for absorbing forces in concrete elements that are supported by support elements, comprising a plurality of reinforcement elements according to claim 1, wherein two reinforcement elements each are aligned parallel to one another and are disposed opposite one another and laterally with respect to the support elements.

* * * * *